US007334987B2

(12) United States Patent
Oh et al.

(10) Patent No.: US 7,334,987 B2
(45) Date of Patent: Feb. 26, 2008

(54) FAN ASSEMBLY FOR VACUUM CLEANER

(75) Inventors: Hyun-jun Oh, Gwangju (KR); Seung-gee Hong, Suwon-si (KR); Hwa-gyu Song, Gwangju (KR); Sung-cheol Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/455,647

(22) Filed: Jun. 20, 2006

(65) Prior Publication Data

US 2007/0122276 A1 May 31, 2007

(30) Foreign Application Priority Data

Nov. 28, 2005 (KR) ..... 10-2005-0114069

(51) Int. Cl.
*F01D 9/02* (2006.01)

(52) U.S. Cl. ..... 415/211.1; 415/211.2

(58) Field of Classification Search ..... 415/211.1, 415/211.2

See application file for complete search history.

(56) References Cited

U.S. PATENT DOCUMENTS 2,967,013 A * 1/1961 Dallenbach et al. ..... 415/181
4,349,314 A * 9/1982 Erwin ..... 415/181
5,178,516 A * 1/1993 Nakagawa et al. ..... 415/208.3
5,310,309 A * 5/1994 Terasaki et al. ..... 415/208.3

FOREIGN PATENT DOCUMENTS

JP 61-207899 9/1986
JP 2005-220853 8/2005

OTHER PUBLICATIONS

Korean Intellectual Property Office, Official Action issued Nov. 16, 2006, with respect to Korean Patent Application No. 2005-114069, filed Nov. 28, 2005.

* cited by examiner

*Primary Examiner*—Ninh H. Nguyen
(74) *Attorney, Agent, or Firm*—Blank Rome LLP

(57) ABSTRACT

A fan assembly for a vacuum cleaner, comprising a motor, an impeller rotatably coupled to the motor, and having a plurality of impeller wings, and a diffuser having a plurality of diffuser wings arranged along an outer circumference of the impeller. The plurality of diffuser wings includes first and second parts, the second part extending from an angle of the first part adjacent to the outer circumference of the impeller.

16 Claims, 8 Drawing Sheets

FAN ASSEMBLY FOR VACUUM CLEANER

REFERENCE TO RELATED APPLICATION

This application claims benefit under 35 U.S.C. § 119(a) of Korean Patent Application No. 2005-114069, filed Nov. 28, 2005 in the Korean Intellectual Property Office, the disclosure of which is incorporated herein by reference.

FIELD OF THE INVENTION

The present invention relates to a vacuum cleaner. More particularly, the present invention relates to a fan assembly for a vacuum cleaner.

BACKGROUND OF THE INVENTION

Generally, vacuum cleaners generate a suction force that draws in dust together with ambient air, and then separates and collects the dust from the air using a dust collecting device. FIG. 1 shows an example of a prior art vacuum cleaner. Referring to FIG. 1, a vacuum cleaner 1 comprises a suction brush 2, an extension pipe assembly 3, and a cleaner body 4. The suction brush 2 has a suction port (not shown) at a lower side to draw in dust from a surface being cleaned. The extension pipe assembly 3 interconnects between the suction brush 2 and the cleaner body 4 and forms a passage for the dust drawn in through the suction brush 2. The cleaner body 4 includes a dust collecting device 6 and a fan assembly 7. The dust collecting device 6 separates and collects the dust from the drawn-in air. A dust bag or a cyclone dust collector can be used for the dust collecting device 6. The fan assembly 7 generates a suction force for drawing in the air.

The fan assembly 7 comprises a motor 9, an impeller (not shown), and a diffuser 8. The impeller is connected to a rotary shaft of the motor 9 and rotated by the motor 9, thereby generating the suction force for drawing in the air. The diffuser 8 induces the air being discharged from the impeller toward the motor 9. Therefore, the drawn-in air cools the motor 9 and exits to the outside passing through a discharge port 5 of the cleaner body 4.

The conventional fan motor, as described above, generates a wind noise due to a flow field formed around the air suction port that collides with wings of the impeller, and generates a blade passing frequency (BPF) noise caused by interaction between the rotating impeller wings and the fixed wings of the diffuser. The BPF noise refers to a peak noise generated at a BPF which the impeller having certain number of wings passes through, and a frequency corresponding to an integral multiple of the BPF. The BPF noise in a vacuum cleaner is often very offensive to a user because it is a strong high-frequency sound.

Korean Patent Registration No. 457551 discloses a fan motor for solving such a problem, in which an upper end of the impeller is protruded more than a lower end and a angled part is formed so that a lower end of a diffuser entrance is protruded more than an upper end. In this structure, the air passes through the lower end of an impeller entrance and is introduced toward the diffuser first, thereby preventing an air whirlpool from being formed at the upper end of the diffuser entrance and accordingly reducing the BPF noise.

However, because the lower end of the diffuser entrance protrudes, the airflow may become turbulent at the lower end of the diffuser entrance, accordingly causing multiple air whirlpools. Simultaneously, the diffuser wings, leading ends of which are angleded at the same angle, may cause BPF noise because the same frequencies are superposed.

SUMMARY OF THE INVENTION

An aspect of the present invention is to solve at least the above problems and/or disadvantages and to provide at least the advantages described below. Accordingly, an aspect of the present invention is to provide a fan assembly for a vacuum cleaner, which is capable of reducing noise generated by an air whirlpool by preventing the air whirlpool from generating at upper and lower ends of a diffuser channel entrance.

In order to achieve the above-described aspects of the present invention, there is provided a fan assembly for a vacuum cleaner, comprising a motor; an impeller rotatably coupled to the motor, and having a plurality of impeller wings; and a diffuser having a plurality of diffuser wings arranged along an outer circumference of the impeller, wherein each of the plurality of diffuser wings includes first and second parts, the second part extending at an angle from the first part adjacent to the outer circumference of the impeller.

The plurality of diffuser wings may be classified into groups so that one group comprises predetermined number of diffuser wings having different height ratios of the second part and the first part, and the groups are repeatedly arranged. Preferably, the height ratios of the diffuser wings in the one group vary in sequence.

According to another embodiment of the present invention, a fan assembly for a vacuum cleaner, comprises a motor; an impeller rotatably coupled to the motor, and having a plurality of impeller wings; and a diffuser having a plurality of diffuser wings arranged along an outer circumference of the impeller. The plurality of diffuser wings are classified into groups so that one group comprises predetermined number of diffuser wings of which one side adjacent to the outer circumference of the impeller have different sloping angles, and the groups are repeatedly arranged.

The plurality of diffuser wings may include an angled part and a vertical part vertically extending from the angled part, on one side adjacent to the outer circumference of the impeller.

According to yet another embodiment of the present invention, a fan assembly for a vacuum cleaner, comprises a motor; an impeller rotatably coupled to the motor, and having a plurality of impeller wings; and a diffuser having a plurality of diffuser wings arranged along an outer circumference of the impeller, wherein at least 50% of the leading ends of the plurality of diffuser wings, adjacent to the outer circumference of the impeller, include both an angled part and a vertical part vertically extended from the angled part.

The plurality of diffuser wings may be arranged in a manner that the diffuser wings having only the angled part and the diffuser wings having both the angled part and the vertical part at the leading end adjacent to the outer circumference of the impeller are alternately arranged.

BRIEF DESCRIPTION OF THE DRAWING FIGURES

The above aspect and other features of the present invention will become more apparent by describing in detail exemplary embodiments thereof with reference to the attached drawing figures, wherein.

Figure 1:
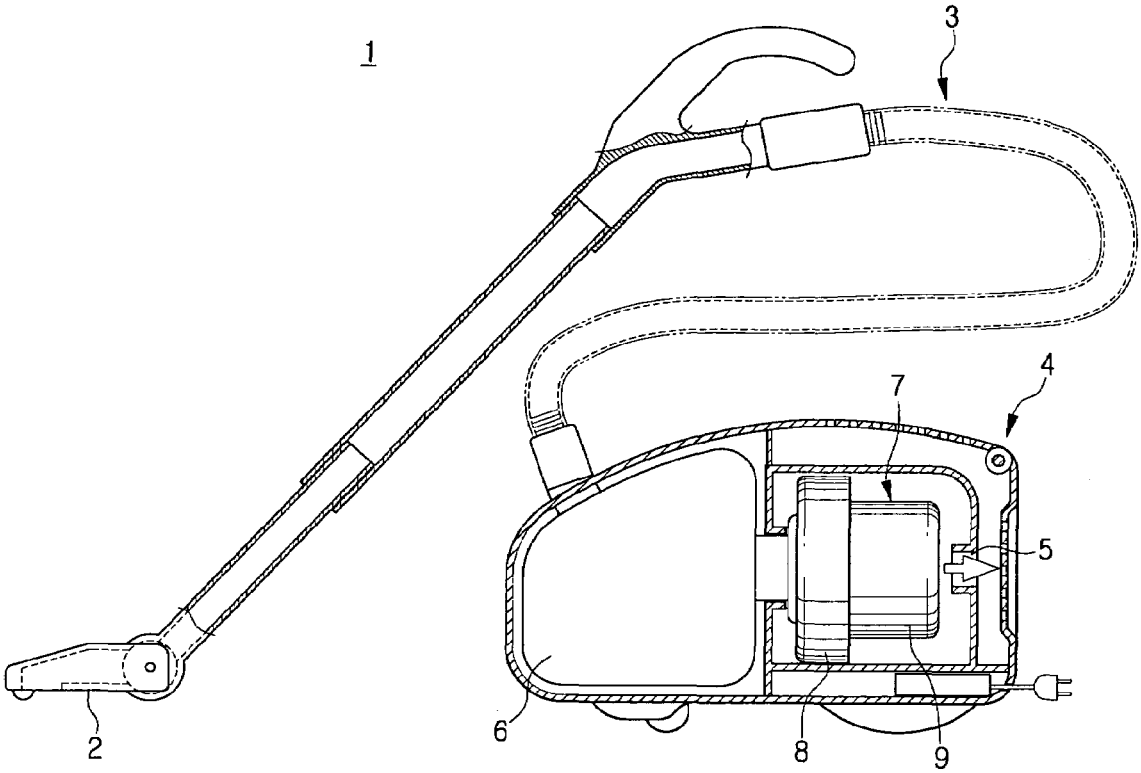
FIG. 1 (BACKGROUND ART)
FIG. 1 is a sectional view schematically showing a conventional vacuum cleaner.
Figure 2:
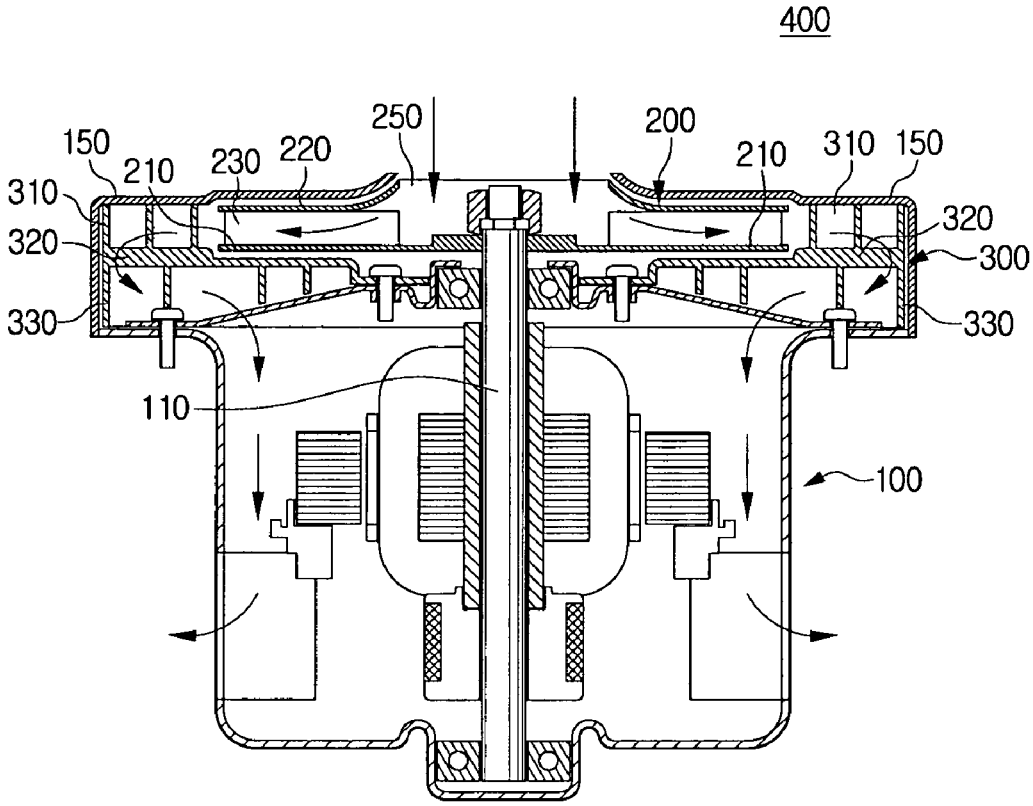
FIG. 2 is a side elevational view of a fan assembly in section for a vacuum cleaner, according to an embodiment of the present invention.
Figure 4:
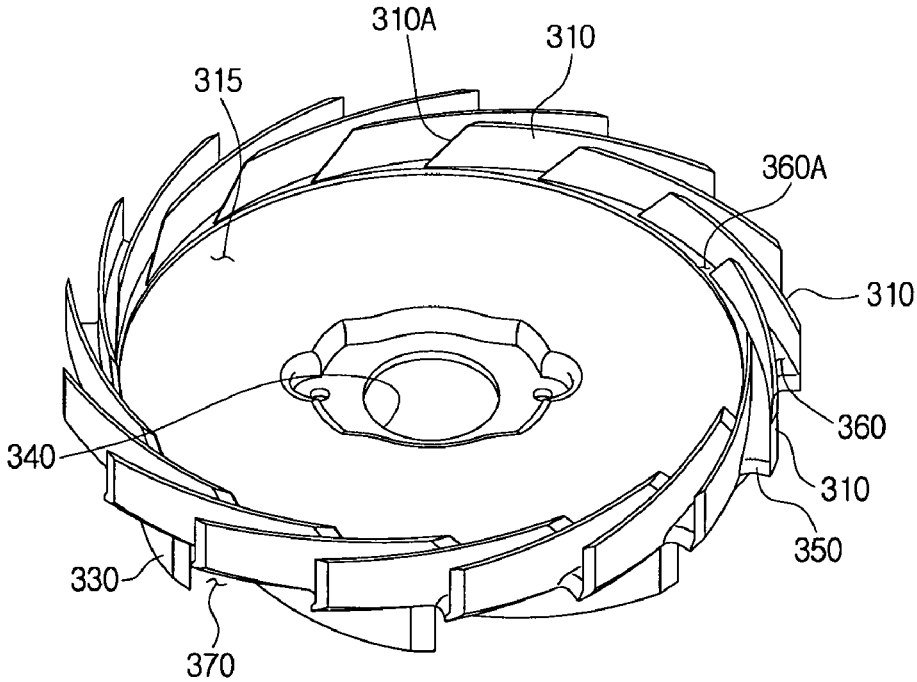
FIG. 4 is a perspective view of a diffuser of the fan assembly for a vacuum cleaner of FIG. 2.
Figure 6A:
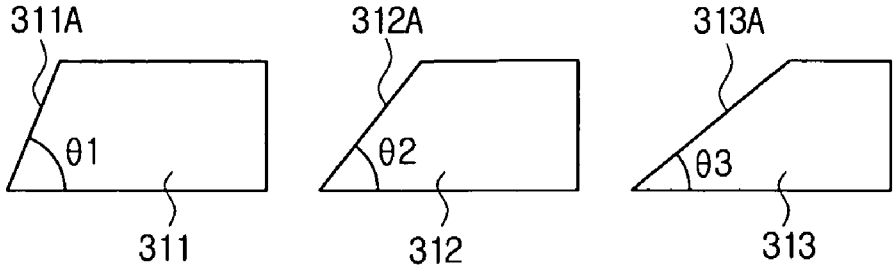
Figure 6B:
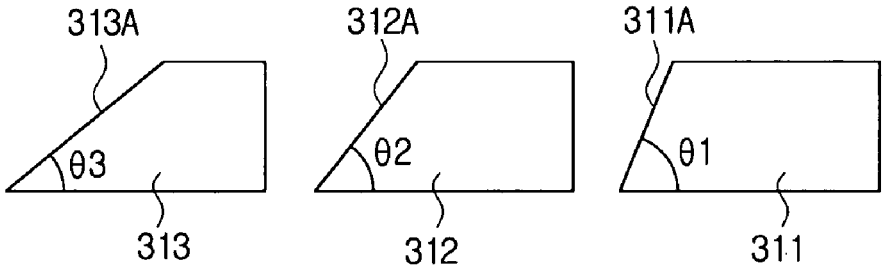
Figure 6C:
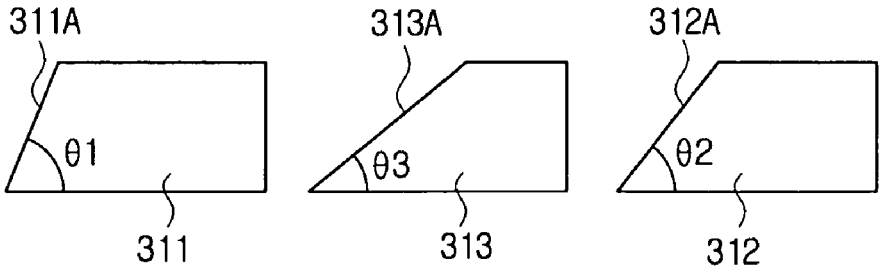
Figure 7:
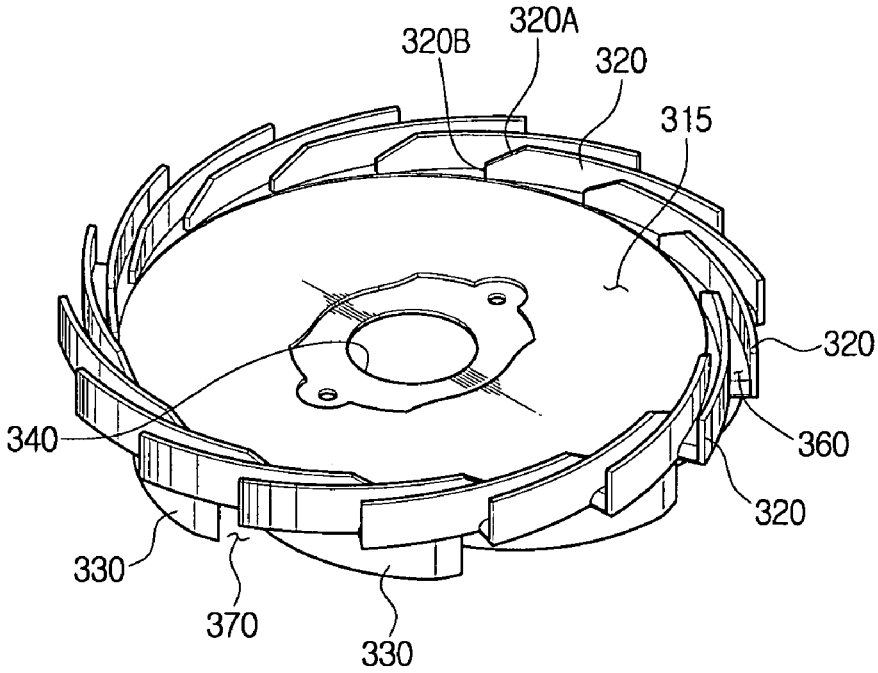
Figure 8:
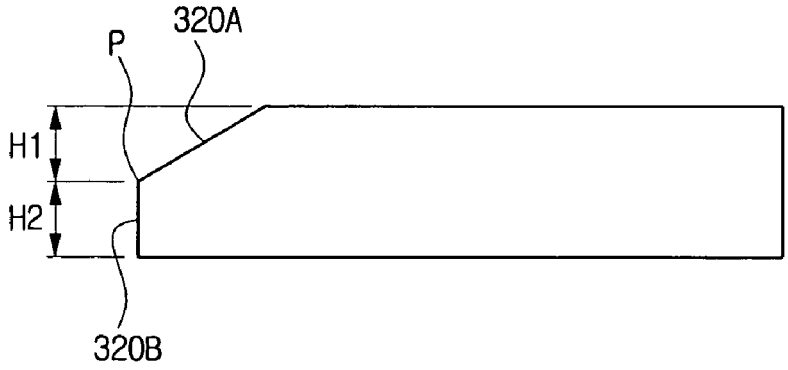
Figure 9A:
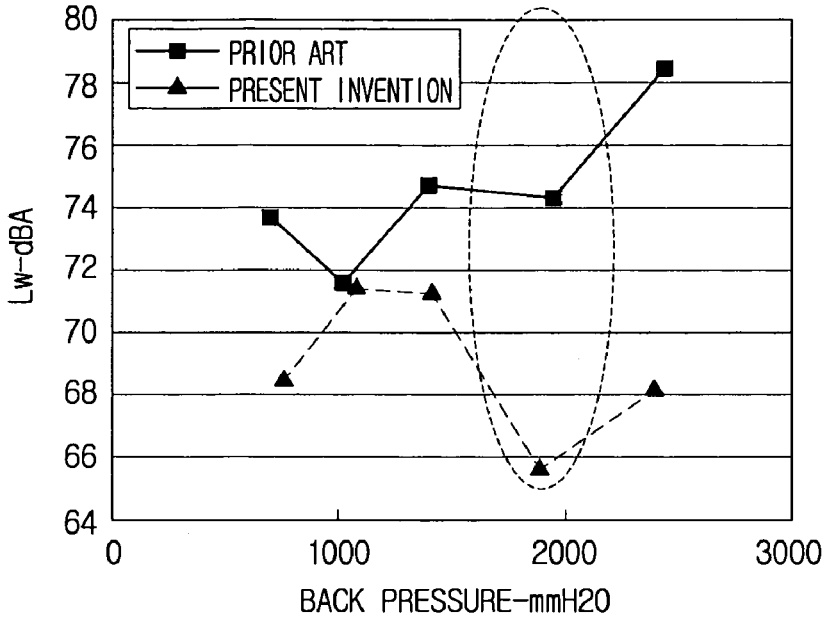
Figure 9B:
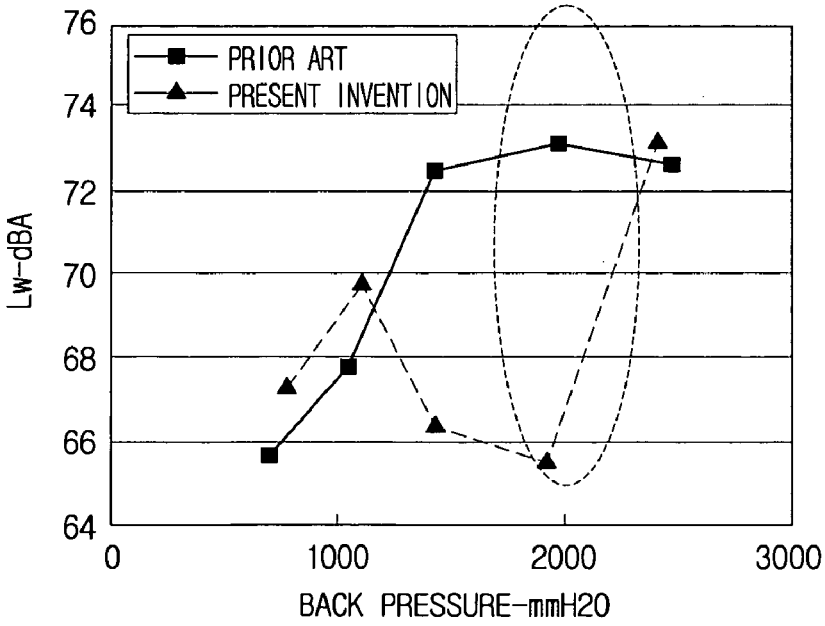
Figure 10A:
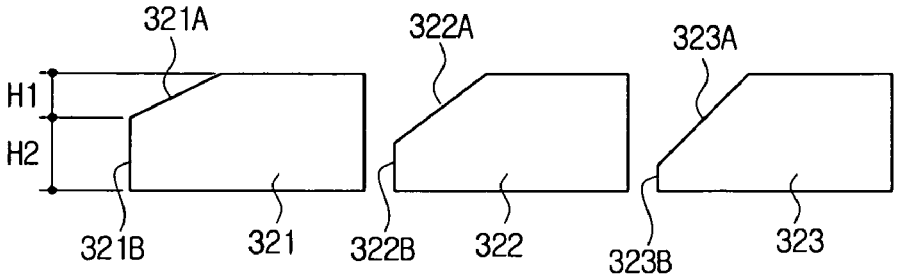
Figure 10B:
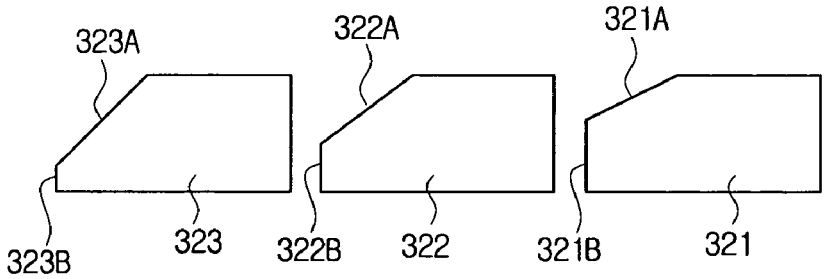
Figure 10C:
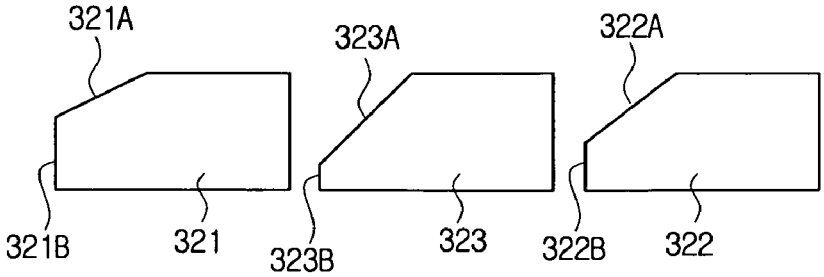

FIGS. 6A through 6C schematically show respectively different arrangements of wings of the diffuser of FIG. 4;

FIG. 7 is a perspective view of a diffuser of the fan assembly for a vacuum cleaner of FIG. 2, according to another embodiment of the present invention;

FIG. 8 is a side view showing a wing of the diffuser of FIG. 6;

FIGS. 9A and 9B are graphs comparing first and second blade passing frequency (BPF) noises in the present invention and the prior art; and FIGS. 10A through 10C schematically show respectively different arrangements of wings of the diffuser of FIG. 7.

DETAILED DESCRIPTION OF THE EXEMPLARY EMBODIMENTS

Hereinafter, certain embodiments of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Referring to FIG. 2, a fan assembly 400 for a vacuum cleaner comprises a motor 100, an upper cover 150, an impeller 200, and a diffuser 300, according to an embodiment of the present invention. The motor 100 rotates the impeller 200. Generally, a motor for a vacuum cleaner having approximately 30,000~36,000 rpm and approximately 1,000~2,000 W may be used. However, other various motors can be adopted as the motor 100 according to the present invention.

Figure 3:
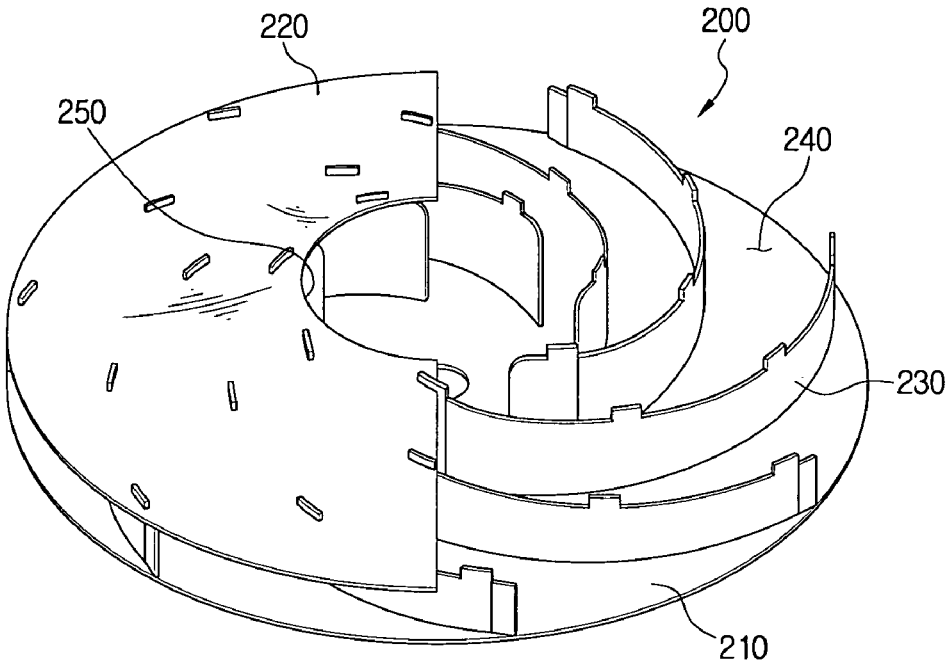
FIG. 3 is a perspective view of an impeller of the fan assembly for a vacuum cleaner of FIG. 2.

Referring to FIG. 3, the upper cover 150 covers an upper part of the impeller 200 and the diffuser 300, thereby forming a space for the impeller 200 to rotate in. Also, the upper cover 150 prevents the air being discharged from the impeller 200 from leaking through the upper end of the diffuser 300. The impeller 200 is driven by the motor 100 and generates a suction force for drawing in air. The impeller 200 comprises upper and lower boards 220 and 210, and a plurality of impeller wings 230.

The upper board 220 has a disc shape and includes an air suction hole 250 at the center thereof. The lower board 210 also has a disc shape corresponding to the upper board 220. The center portion of the lower board 210 is fixed to a motor shaft 110 (See FIG. 2). The plurality of impeller wings 230 are radially arranged at certain intervals between the upper and the lower boards 220 and 210, and may be curved. The air drawn in through the air suction hole 250 of the upper board 220 is discharged to the outside of the impeller 200 through a plurality of air channels formed by the impeller wings 230.

Figure 5:
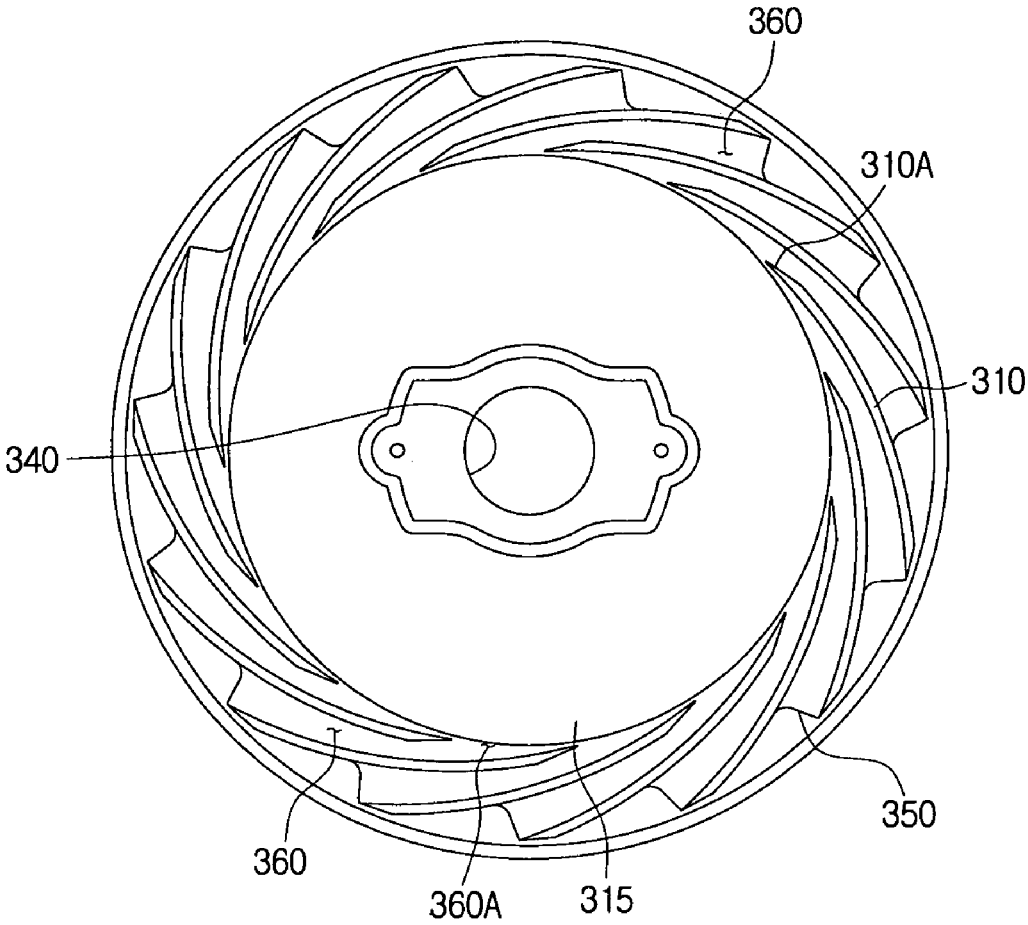
FIG. 5 is a plan view of the diffuser of FIG. 4.

The diffuser 300 increases pressure of the air being discharged from the impeller 200 and guides the air to the motor 110. Referring to FIGS. 4 and 5, the diffuser 300 comprises a diffuser board 315, a plurality of diffuser wings 310, and a plurality of diffuser guide wings 330 (See FIG. 2). The diffuser board 315 is shaped as a disc and interposed between the impeller 200 and the motor 100. The diffuser board 315 has a penetration hole 340 which the motor shaft 110 passes through, at the center thereof. The plurality of diffuser wings 310 are radially arranged at certain intervals along an outer circumference of the diffuser board 315. Each space between two diffuser wings 310 serves as a diffusing channel 360.

A leading end of the diffuser wing 310, adjacent to the impeller 200, forms the entrance of the diffusing channels 360. Here, the plurality of diffuser wings 310 may be curved. The plurality of diffuser guide wings 330 are radially arranged at certain intervals at a lower side of the diffuser board 315. Each space between two diffuser guide wings 330 forms a guiding channel 370.

The plurality of diffuser guide wings 330 are configured to guide the air being drawn in from the plurality of diffusing channels 360 toward the motor 100. Additionally, an opening 350 is formed on the diffuser board 315 for fluid communication of an end of each diffusing channel 360 with the guiding channel 370. The opening 350 enclosed by an upper cover 150 forms an outlet of the diffusing channel 360. Therefore, the air passed through the plurality of diffusing channels 360 is moved to the plurality of guiding channels 370 through the opening 350 and then guided toward the motor 100. A angled part 310A sloped by a predetermined angle in an air flowing direction is formed at the leading end of each diffuser wing 310, which forms the entrance 360A of each diffusing channel 360.

According to an embodiment of the present invention, the sloping angles of the angled parts 310A are varied, and the diffuser wings 310 having the angled parts 310A comprising the various sloping angles are classified as one group. When such groups are repeatedly arranged, increase of the BPF noise caused by the same frequencies superposed can be prevented. The arrangement of the diffuser wings 310 may be various. More specifically, for example, three diffuser wings 311, 312 and 313 including the angled parts 311A, 312A and 313A having respectively different sloping angles $\theta 1$, $\theta 2$ and $\theta 3$ ($\theta 1>\theta 2>\theta 3$) may be arranged in sequence where the sloping angles $\theta 1$, $\theta 2$ and $\theta 3$ are increasing, as shown in FIG. 6A, or decreasing as shown in FIG. 6B. As shown in FIG. 6C, the diffuser wings 311, 312 and 313 may be arranged irregularly, that is, regardless of the sloping angles $\theta 1$, $\theta 2$ and $\theta 3$.

The noise generated by the superposed frequencies can be considerably reduced through the embodiment of the present invention by properly arranging the diffuser wings 311, 312 and 313 having the differently sloped angled or angled parts 311A, 312A and 313A.

As shown in FIG. 7, according to another embodiment of the present invention, an alternative diffuser wing 320 includes a leading end which forms the entrance 360A of the diffusing channel 360 comprises an angled part 320A sloped by a predetermined angle in the air flowing direction and a vertical part 320B vertically extending from the angled part 320A.

Because the diffuser wing 320 includes both the angled part 320A and the vertical part 320B, generation of air whirlpools at the lower end of the entrance 360A of the diffusing channel 360 can be restrained.

More particularly, in the another embodiment of the present invention, a lower part of the leading end of the diffuser wing 320 is formed into the vertical part 320B having a predetermined height H2 (FIG. 8) so that the lower part of the diffuser wing 320 that contacts with the diffuser board 315 does not protrude, thereby preventing an air whirlpool from generating at the lower end of the diffusing channel 360. Also, the angled part 320A extending from an upper end of the vertical part 320B guides the air that passes through the lower end of an outlet 240 (FIG. 3) of the impeller 200 to the diffuser 300 before the air passes through the uppermost end of the outlet 240. Accordingly, generation of air whirlpools at the lower end of the diffusing channel 360 can be prevented. Furthermore, generation of air whirlpools can be prevented at the upper and lower ends of the entrance 360A of the diffusing channel 360 as well. As a result, the noise generated from the fan motor can be wholly attenuated.

Noise reduction efficiency may vary according to the height ratio (H1:H2) between the angled parts and the vertical parts. For example, if H1 denotes the height of the angled part 320A, and border P (FIG. 8) between the angled part 320A and the vertical part 320B approximates the diffuser board 315, then height H2 of the vertical part 320B decreases while height H1 of the angled part 320A increases. In that state, the possibility of generating an air whirlpool at the lower end of the entrance 360A of the diffusing channel 360 increases. If the border P approximates the upper end of the diffuser wing 320, than height H1 of the angled part 320A decreases and height H2 of the vertical part 320B increases. Therefore, the possibility of generating an air whirlpool at the upper end of the entrance of the diffusing channel 360 increases.

Accordingly, heights of the angled part 320A and the vertical part 320B, and the height ratio H1:H2 should be considered. It is preferred that the height H1 is set greater than the height H2, for example, so that the height ratio H1:H2 is about 6:4.

The BPF noises according to shapes of the leading end of the diffuser wings are compared with respect to the conventional art and the embodiment of the present invention, as shown by graphs of FIGS. 9A and 9B. The graph of FIG. 9A shows the result of measuring a first BPF noise. When a back pressure is 2000 mm H2O, the noise in the embodiment of the present invention is approximately 66 dB whereas the noise in the conventional art is approximately 74 dB. That is, the noise is reduced in the present invention by approximately 8 dB.

The graph of FIG. 9B shows the result of measuring a second BPF, that is, a harmonic BPF corresponding to the integral multiple of the first noise. When a back pressure is 2000 mm H2O, the noise in the embodiment of the present invention is approximately 66 dB whereas the noise in the conventional art is approximately 73 dB. In other words, the noise is reduced in the present invention by approximately 7 dB. Thus, the embodiment of the present invention is able to significantly reduce the BPF noise in comparison with the conventional art.

According to another embodiment of the present invention, three diffuser wings 321, 322 and 323 respectively comprising angled parts 321A, 322A and 323A and vertical parts 321B, 322B and 323B, in which the height ratios H1:H2 are differently set, are arranged in order of decreasing the height H2, as shown in FIG. 10A, and increasing the height H2, as shown in FIG. 10B. As shown in FIG. 10C, the three diffuser wings 321, 322 and 323 may be arranged irregularly.

According to the present embodiment, as well as the noise generated by the superposed frequencies, air whirlpools generated at the lower end of the leading end of the diffuser wings 321, 322 and 323 can be reduced by properly arranging the diffuser wings 321, 322 and 323 having the different height ratios H1:H2 of the angled parts 321A, 322A and 323A and the vertical parts 321B, 322B and 323B.

The plurality of diffuser wings of the present invention may comprise only the angled part 310A or both the angled part 320A and the vertical part 320B. Noise reducing effect is high when at least 50% of the diffuser wings have both the angled part 320A and the vertical part 320B. In addition, the diffuser wings having only the angled part 310A and the diffuser wings having both the angled part 320A and the vertical part 320B may be alternately arranged one by one.

Hereinafter, the operation of the fan assembly 40 for a vacuum cleaner as described above will be described with reference to FIGS. 2 through 4.

As the motor 100 rotates, the impeller 200 fixed to the motor shaft 110 is rotated. When the impeller 200 rotates, the air is drawn in through the air suction port 250 and discharged to the diffuser 300 through the outlet of the impeller 200.

The air discharged from the impeller 200 is drawn in through the entrance 360A of the diffusing channel 360, passed through the diffusing channel 360, and discharged to the guiding channel 370 through the opening 350 which is the outlet of the diffusing channel 360. Since superposition of the same frequencies is prevented by the diffuser wings 310 of which the leading ends are arranged by respectively different angles, increase of the BPF noised can also be prevented. As shown in FIG. 7, the angled part 320A and the vertical part 320B of the diffuser wings 320 restrain air whirlpools from generating at the upper and the lower ends of the diffusing channel 360, thereby minimizing the BPF noise caused by rotation of the impeller 200. Then, the air drawn into the guiding channel 370 is passed through the motor 100 and discharged to the outside of the cleaner body through the outlet.

According to the embodiments of the present invention, the BPF noise can be minimized by preventing air whirlpools from generating at the upper and the lower ends of the entrance 360A of the diffusing channel 360. In addition, since superposition of the same frequency, caused by varied shapes of the diffuser wings, can be avoided, increase in noise can be prevented. Furthermore, the suction force of the vacuum cleaner can be constantly maintained, by configuring the diffusing channel 360 so that the pressure is evenly generated at each diffusing channel 360.

While the invention has been shown and described with reference to certain embodiments thereof, it will be understood by those skilled in the art that various changes in form and details may be made therein without departing from the spirit and scope of the invention as defined by the appended claims.

What is claimed is:

1. A fan assembly for a vacuum cleaner, comprising:

a motor;

an impeller rotatably coupled to the motor, and having a plurality of impeller wings; and a diffuser having at least three diffuser wings arranged along an outer circumference of the impeller, wherein each of the at least three diffuser wings includes first and second parts, a surface of the second part extending at an angle from a surface of the first part, adjacent to the outer circumference of the impeller, defining a sloping angle therebetween, the sloping angle of each of the at least three wings being different than the sloping angle of each of the other of the at least three diffuser wings.

2. The fan assembly of claim 1, wherein each first part defines a first height, each second part defines a second height, and a height ratio between the first and second heights of the first part and the second part, respectively, of the diffuser wing is about 6:4.

3. The fan assembly of claim 2, wherein each of the at least three diffuser wings having a different height ratio between respective second and first parts.

4. The fan assembly of claim 3, wherein groups of the diffuser wings are repeatedly arranged.

5. The fan assembly of claim 3, wherein the height ratios of the diffuser wings in one of the groups vary in sequence.

6. The fan assembly of claim 1, wherein the sloping angles of the at least three diffuser wings are arranged with increasing sloping angles.

7. The fan assembly of claim 1, wherein the sloping angles of the at least three diffuser wings are arranged with decreasing sloping angles.

8. The fan assembly of claim 1, wherein the sloping angles of the at least three diffuser wings are arranged with alternating increasing and decreasing sloping angles.

9. A fan assembly for a vacuum cleaner, comprising:

a motor;

an impeller rotatably coupled to the motor, and having a plurality of impeller wings; and a diffuser having at least three diffuser wings arranged along an outer circumference of the impeller, wherein each of the at least three diffuser wings has a side adjacent to the outer circumference of the impeller having a sloping angle, each of the sloping angles being different from one another, and the at least three diffuser wings are repeatedly arranged.

10. The fan assembly of claim 9, wherein the sloping angles of the at least three diffuser wings are arranged with increasing sloping angles.

11. The fan assembly of claim 9, wherein the sloping angles of the at least three diffuser wings are arranged with decreasing sloping angles.

12. The fan assembly of claim 9, wherein the sloping angles of the at least three diffuser wings are arranged with alternating increasing and decreasing angles.

13. A fan assembly for a vacuum cleaner, comprising:

a motor;

an impeller rotatably coupled to the motor, and having a plurality of impeller wings; and a diffuser having a plurality of diffuser wings arranged along an outer circumference of the impeller, wherein the leading ends of at least three diffuser wings, adjacent to the outer circumference of the impeller, include an angled part and a vertical part vertically extended from the angled part defining a sloping angle therebetween, and the sloping angles of each of the at least three diffuser wings being different from one another.

14. The fan assembly of claim 13, wherein the plurality of diffuser wings are arranged in a manner such that the diffuser wings having only the angled part and the diffuser wings having both the angled part and the vertical part at the leading end adjacent to the outer circumference of the impeller are alternately arranged.

15. The fan assembly of claim 13, wherein the sloping angles being arranged with one of increasing sloping angles, decreasing sloping angles, or alternating increasing and decreasing sloping angles.

16. A fan assembly for a vacuum cleaner, comprising:

a motor;

an impeller rotatably coupled to the motor, and having a plurality of impeller wings; and a diffuser having a plurality of diffuser wings arranged along an outer circumference of the impeller, wherein at least 50% of the leading ends of the plurality of diffuser wings, adjacent to the outer circumference of the impeller, include an angled part and a vertical part vertically extended from the angled part, and the plurality of diffuser wings are arranged in a manner such that the diffuser wings having only the angled part and the diffuser wings having both the angled part and the vertical part at the leading end adjacent to the outer circumference of the impeller are alternately arranged.

* * * * *